United States Patent [19]

Roiz et al.

[11] Patent Number: 4,602,185

[45] Date of Patent: Jul. 22, 1986

[54] ARC TUBE SUPPORT OF GASEOUS-DISCHARGE LAMP

[75] Inventors: Lev M. Roiz; Mikhail M. Petukhov; Arkady I. Kagansky, all of Poltava, U.S.S.R.

[73] Assignee: Poltavsky Zavod Gazorazryadnykh Lamp Imeni Komsomola Ukrainy, Moscow, U.S.S.R.

[21] Appl. No.: 672,245

[22] PCT Filed: Mar. 24, 1984

[86] PCT No.: PCT/SU83/00006

§ 371 Date: Oct. 31, 1984

§ 102(e) Date: Oct. 31, 1984

[87] PCT Pub. No.: WO84/03797

PCT Pub. Date: Sep. 27, 1984

[51] Int. Cl.[4] ..... H01J 1/52; H01J 19/40

[52] U.S. Cl. ..... 313/25; 313/324

[58] Field of Search ..... 313/25, 26, 312, 324, 313/634

[56] References Cited

U.S. PATENT DOCUMENTS

| | | | |
|---|---|---|---|
| 2,802,961 | 8/1957 | Jenne, Jr. | 313/25 |
| 2,830,210 | 9/1954 | Jenne, Jr. et al. | 313/25 |
| 2,918,592 | 12/1959 | Pomfvett et al. | 313/25 |
| 3,218,495 | 11/1965 | Hasell et al. | 313/25 |
| 4,341,975 | 7/1982 | Phillipp et al. | 313/25 |

*Primary Examiner*—Davis L. Willis
*Assistant Examiner*—William L. Oen
*Attorney, Agent, or Firm*—Burgess, Ryan & Wayne

[57] ABSTRACT

This invention relates to electrical engineering.

An arc tube support of a gaseous-discharge lamp is made from one piece of bent wire and has a central straight portion (1) placed along the arc tube (4) and loop-like end portions (2) embracing the sealed-in ends (5) of the arc tube (4). The loop-like portions (2) are made as spring grips and embrace the sealed-in ends (5) of the arc tube halfway.

The support can be used for manufacturing arc mercury-quartz luminescent high-pressure lamps.

4 Claims, 6 Drawing Figures

ARC TUBE SUPPORT OF GASEOUS-DISCHARGE LAMP

FIELD OF THE INVENTION

The present invention relates to electrical engineering, concerns lighting equipment and, in particular, an arc tube support of a gaseous-discharge lamp.

PRIOR ART

Known gaseous-discharge lamps are usually made as a glass bulb wherein an arc tube is mounted on a support and is electrically connected with the metal base of the lamp, which is intended for screwing the lamp in the lighting fixture.

Known in the art is an arc tube support of a gaseous-discharge lamp, comprising several separate mounting elements, such as loops, brackets, plates and other, which embrace the sealings of the arc tube and are secured, by electric welding, to metal props of wire. This type of support is typical for discharge lamps manufactured by Polan in Poland, by Tesla in Czechoslovakia, by other companies.

However, such arc tube supports require too much metal and are still insufficiently reliable since the number of welding points per lamp vary from 11 to 27. In addition, the fastening elements cannot be reused if some defects in arc tubes or lamps are revealed at a later stage of the technological manufacturing process, since the structure is welded and nondetachable.

Also known in the art is an arc tube support for a gaseous-discharge lamp, which is made from one piece of bent wire having a central straight portion extending along the arc tube and looped ends. These looped ends envelop the sealed-in ends of the arc tube and form closed loops welded together (cf., for example U.S. Pat. No. 3,218,495 Cl. 313-25, published in 1965).

However such arc tube support, like the one described above, cannot be reused in the manufacturing process in case some defects of arc tubes or lamps are exposed at a later stage, since the looped portions thereof are welded together. In addition, the bending and welding of the looped portions is done after the arc tubes are fitted therein, and the arc tubes can be accidentally damaged.

DISCLOSURE OF THE INVENTION

An object of present invention is to provide an improved arc tube support of a gaseous-discharge lamp, which is reliable and can be reused in case some defects of arc tubes or lamps are revealed at a later stage of manufacture.

This is achieved in that in an arc tube support of a gaseous-discharge lamp, which is made from bent wire having a central straight portion extending along the arc tube and loop-like end portions enveloping the sealed-in ends of the arc tube, according to the invention, the loop-like portions are made as spring grips partially embracing the sealed-in ends of the arc tube.

The spring grips can have their open parts facing in one direction or towards each other.

The arc tube support of a gaseous-discharge lamp, according to the invention, is uncomplicated but reliable, convenient for assembly, and reusable if other components of the gaseous-discharge lamp become defective in the process of manufacturing.

BRIEF DESCRIPTION OF DRAWINGS

The invention will now be described in greater detail with reference to a specific embodiment thereof, taken in conjunction with the accompanying drawings, wherein.

BEST MODE FOR CARRYING OUT THE INVENTION

Figure 1:
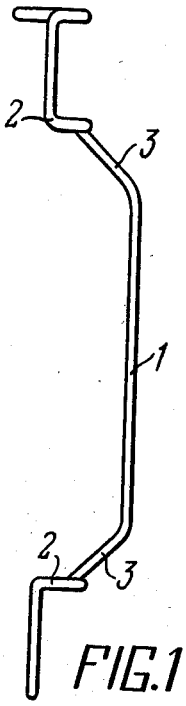
FIG. 1 shows a front view of an arc tube support of a gaseous-discharge lamp, according to a preferred embodiment of the invention.
Figure 2:
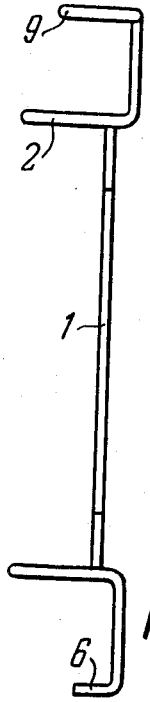
FIG. 2 shows a side view of FIG. 1.
Figure 3:
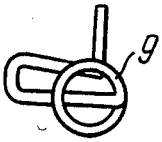
FIG. 3 shows a top view of FIG. 1.

The arc tube support of FIGS. 1,2 and 3 is made of a piece of wire and has a straight central portion 1, end loop-like portions 2 which are spring grips, and transition portions 3 between the straight portion 1 and the end portions 2, which are bent to 45° in relation to the straight portion 1. In the support embodiment of FIGS. 1,2,3 the loop portions 2 have their open parts facing in the same direction.

Figure 4:
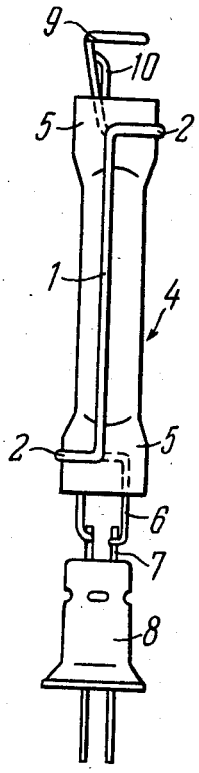
FIG. 4 shows a support assembly featuring an arc tube and a comb stem.

Another support embodiment as shown in FIG. 4 has, according to the invention, the open parts of its loop portions 2 facing towards each other. The straight portion 1 extends along the arc tube 4 and the loop-like portions 2 embrace the sealed-in ends 5 of the arc tube 4 to their half-width, that is half of the traverse width thereof. The lower end 6 of the support is bent parallel to the loop portions 2 and welded to the lead 7 of a crested stem 8. The upper end 9 of the support is made as a ring to secure the support in the dome of the bulb.

The arc tube support of a gaseous-discharge lamp, made according to the invention, is assembled together with the arc tube and other lamp components as follows.

Figure 5:
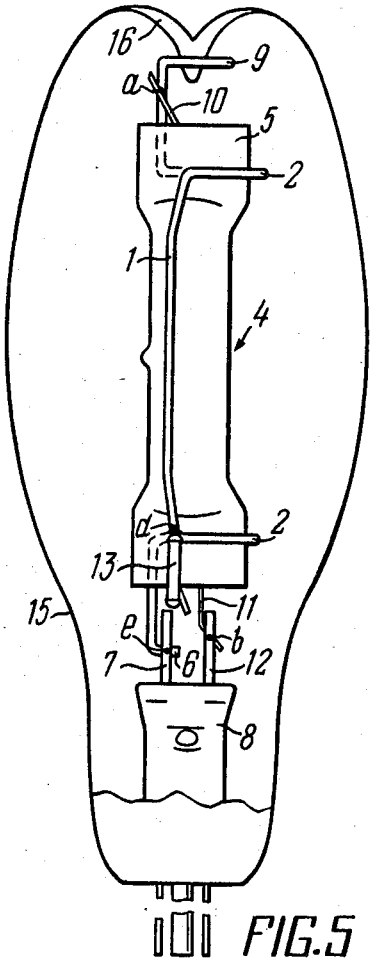
FIG. 5 shows a front view of a support inside a gaseous-discharge lamp bulb.
Figure 6:
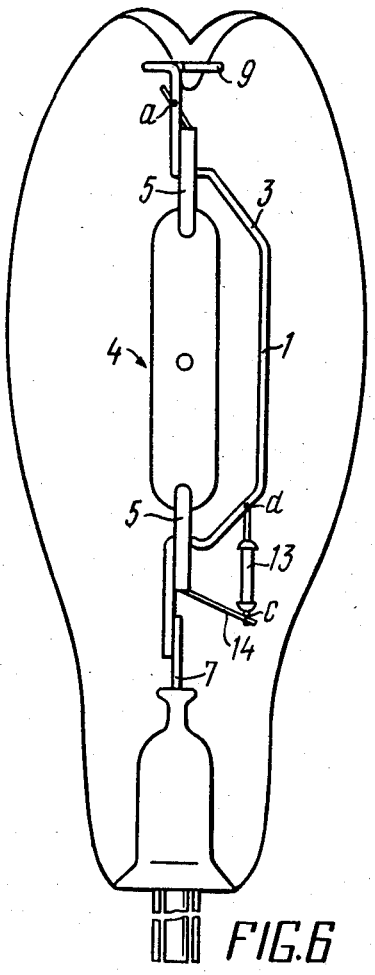
FIG. 6 shows a side view of FIG. 5.

The sealed-in ends 5 (FIGS. 5 and 6) of the arc tube are placed into the spring grips which are loop portions 2 embracing the sealed-in ends 5 halfway, and are secured therein. It should be pointed out that the support embodiment of FIGS. 1,2, and 3 is more convenient to assemble, while the embodiment of FIG. 4 ensures a more reliable locking of the arc tube 4. The upper lead 10 (FIG. 5) of the arc tube is welded to the upper end 9 of the support (point a), while the lower lead 11 of the arc tube 4 is welded to the lead 12 of the crested stem 8 (point b).

Next, the resistor 13 (FIG. 6) has to be connected at one end to a lead 14 of the arc tube 4 (point C) and at the other end to the support (point d).

The lower end 6 (FIG. 5) of the support is welded to the lead 7 of the crested stem 8 (point e). To secure the arc tube with the support in a bulb 15 of the discharge lamp, the annular upper end 9 of the support is fitted on an inner projection 16 of the dome of the bulb 15, thus fixing the support inside the bulb 15 of the lamp.

The support can, according to the invention, be reused many times over.

If the quartz arc tube 4 is found defective in the process of manufacturing, the support is released by cutting the leads 10 and 11, and can be reused.

If the bulb 15 is found defective, the leads 7 and 12 are cut and the support, together with the arc tube 4, is secured to a new crested stem.

The arc tube support of a gaseous-discharge lamp, according to the invention, can be made by an automated process since it involves no additional assembly operations, when fitted to the arc tube, the number of welding points is reduced to five making the manufacturing process less complicated and the structure more reliable. The arc tube support according to the invention can be reused many times over, since, if the arc tube is found defective, the leads to be cut belong to the arc tube and not to the support. The shape of the support makes for a very rigid connection of the arc tube in all directions without resorting to additional welding.

INDUSTRIAL APPLICABILITY

The present invention can be used for making lighting sources, for example, for manufacturing arc mercury-quartz high-pressure luminescent lamps. Such lamps are used for lighting streets, sporting facilities and industrial premises.

We claim:

1. An arc tube support of a gaseous-discharge lamp, made from bent wire having a central straight portion extending along an arc tube and end loop-like portions embracing sealed-in ends of the arc tube, characterized in that the loop-like portions are made as spring grips with a single bend releasably embracing the sealed-in ends of the arc tube halfway of the traverse width thereof.

2. An arc tube support of a gaseous-discharge lamp as claimed in claim 1, characterized in that the spring grips have their open parts facing in one direction.

3. An arc tube support of a gaseous-discharge lamp as claimed in claim 1, characterized in that the spring grips have their open parts facing into each other.

4. An arc tube support of a gaseous-discharge lamp as claimed in claim 1, wherein said spring grips have a substantially semi-circular configuration.

* * * * *